US009128503B2

(12) United States Patent
Venkiteswaran et al.

(10) Patent No.: US 9,128,503 B2
(45) Date of Patent: Sep. 8, 2015

(54) UNIFIED BANDGAP VOLTAGE CURVATURE CORRECTION CIRCUIT

(71) Applicant: Texas Instruments, Incorporated, Dallas, TX (US)

(72) Inventors: Mahadevan Venkiteswaran, Bangalore (IN); Srikanth Parthasarathy, Bangalore (IN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 143 days.

(21) Appl. No.: 14/067,736

(22) Filed: Oct. 30, 2013

(65) Prior Publication Data

US 2015/0116027 A1 Apr. 30, 2015

(51) Int. Cl.
*G05F 1/46* (2006.01)

(52) U.S. Cl.
CPC ..... *G05F 1/463* (2013.01); *G05F 1/461* (2013.01)

(58) Field of Classification Search
USPC ..... 327/512–513, 538, 539, 543; 323/312–316
See application file for complete search history.

(56) References Cited

U.S. PATENT DOCUMENTS

| | | | | |
|---|---|---|---|---|
| 8,542,000 | B1 * | 9/2013 | Youssefi | 323/313 |
| 8,941,369 | B2 * | 1/2015 | Youssefi | 323/313 |
| 2007/0052473 | A1 * | 3/2007 | McLeod | 327/539 |

* cited by examiner

*Primary Examiner* — An Luu
(74) *Attorney, Agent, or Firm* — John R. Pessetto; Charles A. Brill; Frank D. Cimino

(57) ABSTRACT

A unified bandgap voltage waveform compensation amplifier is arranged having shared input transistor pairs, a shared load resistor, and shared current sources. For example, a first amplifier structure is arranged to produce a negative-going bias correction signal when a bandgap voltage reference increases as operating temperatures rise and a second amplifier structure is arranged to produce a positive-going bias correction signal when the bandgap voltage reference increases as operating temperatures rise. The unified amplifier is arranged to combine the positive-and negative-going signals to generate a combined compensation current that is used to compensate for temperature instability of the bandage voltage reference.

20 Claims, 5 Drawing Sheets

600

900.0
850.0
800.0
750.0
700.0
650.0
600.0
550.0
V (mV)
60.0
50.0
40.0
30.0
20.0
10.0
0.0
-10.0
I (nA)
614
756.6mV
610
672.75mV
612
616
-50.0
-25.0
0.0
25.0
50.0
75.0
100.0
dc (C)

700

1.23475
1.23450
1.23425
1.23400
1.23375
1.23350
V (V)
710
712
-50.0
-25.0
0.0
25.0
50.0
75.0
100.0
dc (C)

UNIFIED BANDGAP VOLTAGE CURVATURE CORRECTION CIRCUIT

BACKGROUND

Electronic circuits are designed using increasingly smaller design features to attain increased integration and reduced power consumption. An example of such increasingly integrated circuits, includes SoC (System on Chip) designs implemented using VLSI (very large scale integration). Power management (including controlling power consumption and heat dissipation) are significant design concerns in such VLSI circuits. For example, the rate and amounts of power consumption affects the operating temperatures, lifetimes, battery longevity for mobile devices, and the like, of the devices incorporating the VLSI circuits. However, as the design features of integrated circuits are increasingly made smaller, variability of the electrical characteristics of the components of the integrated circuits increasingly jeopardizes proper operation of the integrated circuits.

SUMMARY

The problems noted above can be solved in large part by a PWL (piecewise linear) curvature compensation circuit that is arranged to compensate, for example, temperature-dependent deviations of a voltage reference signal produced by a bandgap voltage generator. The PWL curvature compensation circuit includes a unified amplifier that is arranged to provide a negative-going bias correction when the bandgap voltage reference increases over a first range of temperatures and to provide a positive-going bias correction signal when the bandgap voltage reference decreases over a second range of temperatures.

The unified amplifier includes a stacked input transistor pair (for receiving reference signals), a shared load resistor, and common tail and load current sources that are arranged in an area- and power-efficient configuration. When the unified amplifier is arranged in a substrate using a similar layout to a bandgap voltage generator (also arranged in the substrate), temperature compensation is improved because thermal effects on the structures of the bandgap voltage generator are similar to the thermal effects on the structures of the unified amplifier.

The unified amplifier is arranged without having separate input transistor pairs, a separate load resistor, and separate current sources that would otherwise be used by separate amplifiers. For example, a first amplifier structure is arranged to produce a negative-going bias correction signal when the bandgap voltage reference increases as operating temperatures rise and a second amplifier structure is arranged to produce a positive-going bias correction when the bandgap voltage reference increases as operating temperatures rise. Accordingly, the unified amplifier shares input transistor pairs, the load resistor, and current sources used to generate the PWL compensation current.

This Summary is submitted with the understanding that it is not be used to interpret or limit the scope or meaning of the claims. Further, the Summary is not intended to identify key features or essential features of the claimed subject matter, nor is it intended to be used as an aid in determining the scope of the claimed subject matter.

BRIEF DESCRIPTION OF THE DRAWINGS

The following figures show example embodiments according to the inventive subject matter, unless noted as showing prior art.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be example of that embodiment, and not intended to intimate that the scope of the disclosure, including the claims, is limited to that embodiment.

Certain terms are used throughout the following description—and claims—to refer to particular system components. As one skilled in the art will appreciate, various names may be used to refer to a component or system. Accordingly, distinctions are not necessarily made herein between components that differ in name but not function. Further, a system can be a sub-system of yet another system. In the following discussion and in the claims, the terms "including" and "comprising" are used in an open-ended fashion, and thus are to be interpreted to mean "including, but not limited to . . . . " Also, the terms "coupled to" or "couples with" (and the like) are intended to describe either an indirect or direct electrical connection. Thus, if a first device couples to a second device, that connection can be made through a direct electrical connection, or through an indirect electrical connection via other devices and connections.

Figure 1:
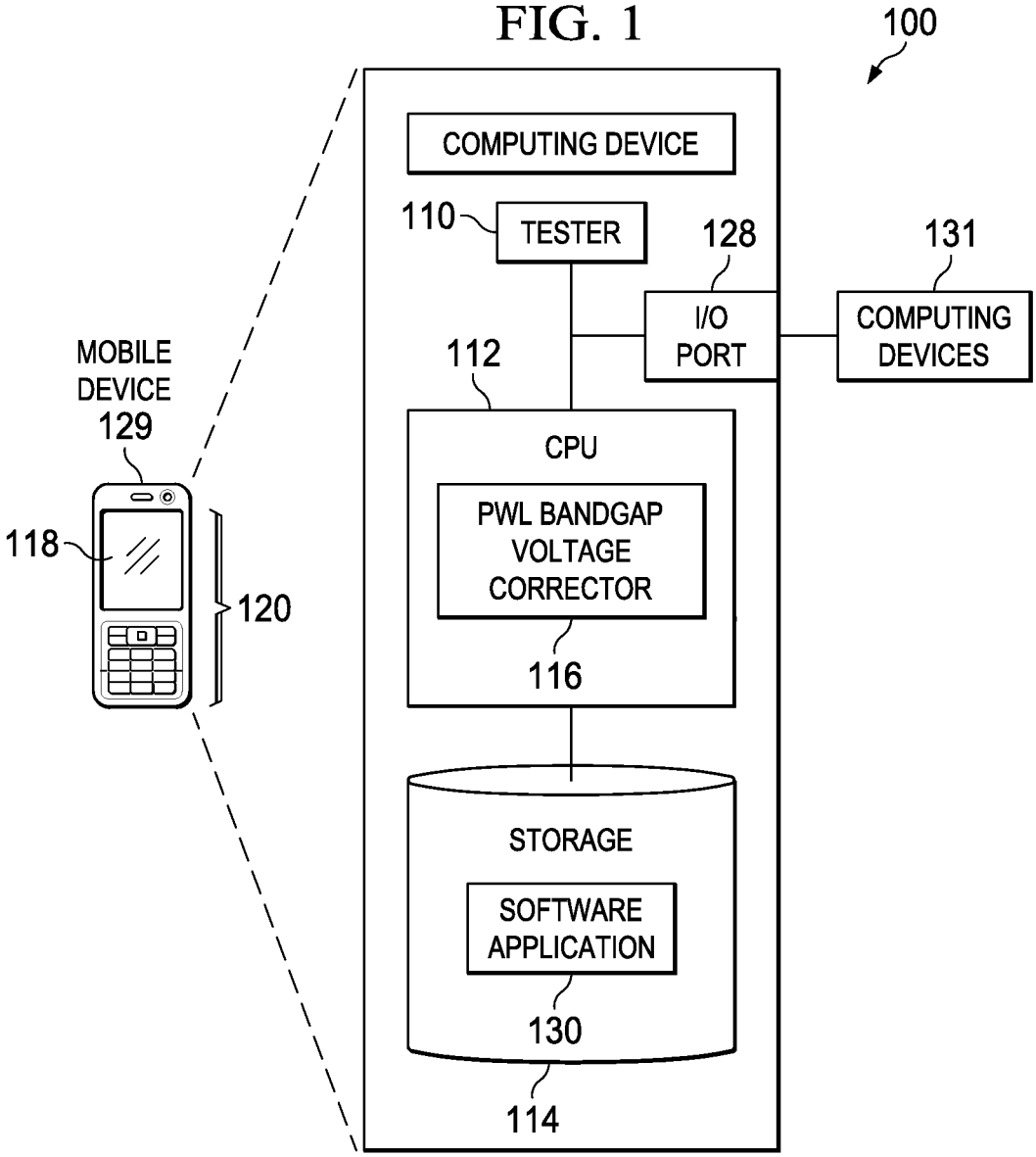
FIG. 1 shows an illustrative electronic device in accordance with example embodiments of the disclosure.

FIG. 1 is a block diagram illustrating a computing device 100 in accordance with example embodiments of the disclosure. For example, the computing device 100 is, or is incorporated into, a mobile communication device 129, such as a mobile phone, a personal digital assistant, a personal computer, automotive electronics, projection (and/or media-playback) unit, or any other type of electronic system.

In some example embodiments, the computing device 100 comprises a megacell or a system-on-chip (SOC) which includes control logic such as a CPU 112 (Central Processing Unit), a storage 114 (e.g., random access memory (RAM) and/or disk storage) and a tester 110. The CPU 112 can be, for example, a CISC-type (Complex Instruction Set Computer) CPU, RISC-type CPU (Reduced Instruction Set Computer), or a digital signal processor (DSP). As further discussed below, CPU 112 can be a multicore processor, for example a heterogeneous multicore processor including a combination of one or more cores.

The storage 114 (which can be memory such as RAM, flash memory, or disk storage) stores one or more software applications 130 (e.g., embedded applications) that, when executed by the CPU 112, perform any suitable function associated with the computing device 100. For example, power supply related functions (such as power data logging over temperature) can be implemented using program and/or data information stored in storage 114.

The tester 110 comprises logic that supports testing and debugging of the computing device 100 executing the software application 130. For example, the tester 110 can be used to emulate a defective or unavailable component(s) of the computing device 100 to allow verification of how the component(s), were it actually present on the computing device 100, would perform in various situations (e.g., how the component(s) would interact with the software application 130). In this way, the software application 130 can be debugged in an environment which resembles post-production operation.

The CPU 112 comprises memory and logic that processes and/or (at least temporarily) stores information under control of programs accessed from the storage 114. The computing device 100 is often controlled by a user using a UI (user interface) 120, which provides output to and receives input from the user during the execution the software application 130. The output is provided using the display 118, indicator lights, a speaker, vibrations, and the like. The input is received using audio and/or video inputs (using, for example, voice or image recognition), and electro-mechanical devices such as keypads, switches, proximity detectors, and the like. CPU 112 may execute operating system tasks and/or application specific tasks that manipulate text, numbers, graphics, audio, video or a combination of these elements (e.g., in audio and/or video steaming applications).

The CPU 112 and tester 110 are coupled to I/O (Input-Output) port 128, which provides an interface that is configured to receive input from (and/or provide output to) peripherals and/or computing devices 131, including tangible (e.g., "non-transitory") media (such as flash memory) and/or cabled or wireless media (such as a Joint Test Action Group (JTAG) interface). These and other input and output devices are selectively coupled to the computing device 100 by external devices using wireless or cabled connections. The CPU 112, storage 114, and tester 110 are also coupled to a programmable power supply (not shown), which is configured to receive power from a power source 136 (such as a battery, solar cell, "live" power cord, inductive field, fuel cell, and the like).

The CPU 112 (and/or the substrate upon which the CPU 112 is formed) includes a PWL bandgap voltage corrector 116. The PWL bandgap voltage corrector 116 is arranged to provide PWL curvature to improve the curvature of the bandgap voltage over a range of operating temperatures. The PWL bandgap voltage corrector 116 provides an area and power efficient PWL current generation circuit that can be used to reduce temperature fluctuation-caused bandgap voltage curvature. Although the PWL bandgap voltage corrector is illustrated a being a part of (and/or on the same substrate as) CPU 112, the PWL bandgap voltage corrector can be implemented in a variety of system components, including analog domains, analog-to-digital converters, microcontrollers, SoCs, and the like.

Figure 2:
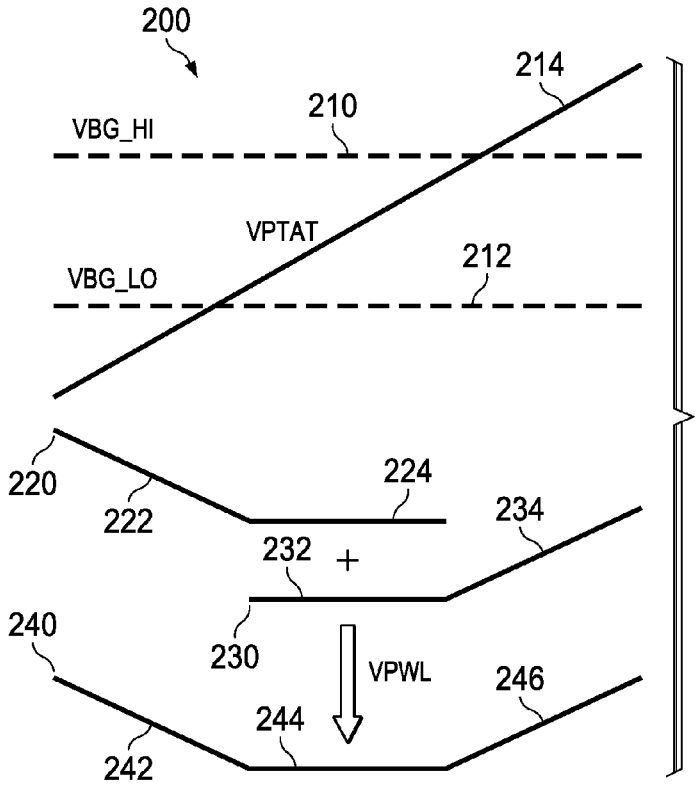
FIG. 2 is a waveform diagram illustrating unified PWL bandgap voltage compensation generation in accordance with example embodiments of the disclosure.

FIG. 2 is a waveform diagram illustrating unified PWL bandgap voltage compensation generation in accordance with example embodiments of the disclosure. Graph 200 includes signal VBG_HI (voltage bandgap high) 210 and signal VBG_LO (voltage bandgap low) 212 that are illustrated as remaining substantially constant.

Signal VPTAT (voltage proportional to absolute temperature) 214 is illustrated in graph 200 as increasing as a function of temperature (e.g., where temperature increases from left to right). Signal VPTAT can be supplied by a thermal voltage generator of a bandgap voltage generator and is used to bias transistors of the PWL bandgap voltage corrector 116 (e.g., as discussed with reference to FIG. 4, below).

The intersection of signal VPTAT 214 with VBG_HI 210 represents first point at which temperature compensation is no longer applied to a bandgap voltage generator. For example, as temperature increases, the magnitude of the (e.g., instantaneous) slope of bandgap voltage gradually decreases until the bandgap voltage (e.g., bandgap voltage 712 of FIG. 7) reaches a maximum value (at which point the slope is zero). The intersection of signal VPTAT 214 with VBG_HI 210 can be a point, for example, where the magnitude of the slope is around unity (e.g., the rise is equal to the run).

The intersection of signal VPTAT 214 with VBG_LO 212 represents second point at which temperature compensation is to be reapplied to a bandgap voltage generator. For example, as temperature increases, the magnitude of the (instantaneous) slope of bandgap voltage parabolically increases. The intersection of signal VPTAT 214 with VBG_LO 212 can be a point, for example, where the magnitude of the slope is around unity.

Curve 220 is a PWL correction curve that is used to correct a voltage produced by the bandgap voltage generator while the bandgap voltage increases as a function of temperature. Segment 222 illustrates a negative-going correction signal that is used to compensate for temperature effects on the voltage generated by the bandgap voltage generator until, for example, the bandgap voltage is substantially stable. The bandgap voltage is substantially stable, for example, when the magnitude of the slope of the bandgap voltage is less than unity. Segment 224 illustrates a level (e.g., non-correcting) correction signal that maintains a bandgap voltage level that is not (e.g., further) corrected as a function of temperature.

Curve 230 is a PWL correction curve that is used to correct a voltage produced by the bandgap voltage generator while the bandgap voltage decreases as a function of temperature. Segment 232 illustrates a level (e.g., non-correcting) correction signal that maintains a bandgap voltage level that is not (e.g., further) corrected as a function of temperature, whereas segment 234 illustrates a positive-going correction signal that is used to compensate for temperature effects on the voltage generated by the bandgap voltage generator after, for example, the bandgap voltage substantially increases as a function of temperature. The bandgap voltage substantially increases, for example, when the magnitude of the slope of the bandgap voltage is greater than unity.

Curve 240 is a unified (e.g., formed by combining curves 220 and 230) PWL correction curve that is used to correct a voltage produced by the bandgap voltage generator while the bandgap voltage increases and decreases as a function of temperature. Segment 242 illustrates a negative-going correction signal that is used to compensate for temperature effects on the voltage generated by the bandgap voltage generator until, for example, the bandgap voltage is substantially stable. Segment 244 illustrates a level (e.g., non-correcting) correction signal that maintains a bandgap voltage level that is not (e.g., further) corrected as a function of temperature. Segment 246 illustrates a positive-going correction signal that is used to compensate for temperature effects on the voltage generated by the bandgap voltage generator after, for example, the bandgap voltage substantially increases as a function of temperature.

Figure 3:
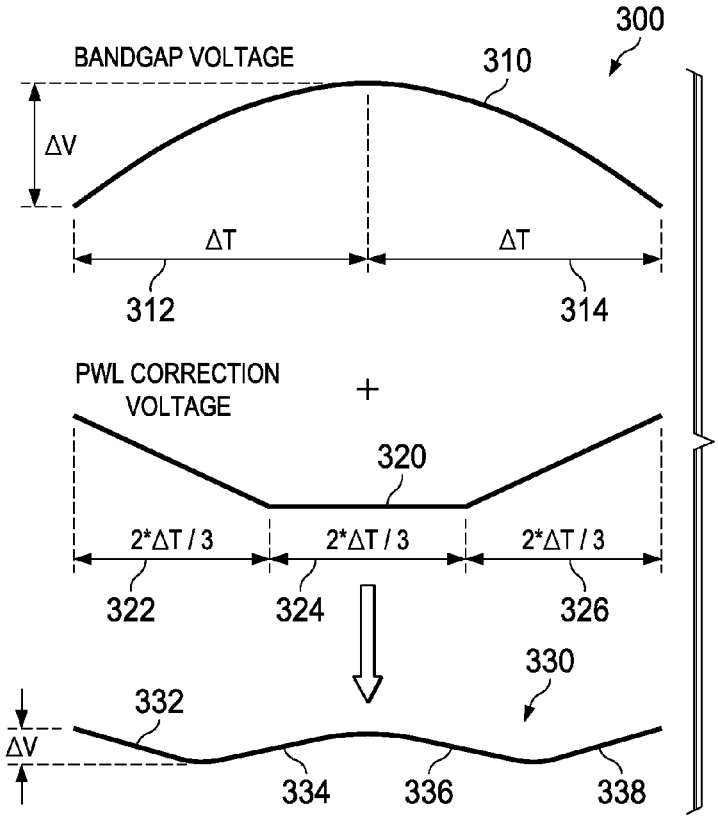
FIG. 3 is a waveform diagram illustrating unified PWL bandgap voltage waveform compensation in accordance with example embodiments of the disclosure.

FIG. 3 is a waveform diagram illustrating unified PWL bandgap voltage waveform compensation in accordance with example embodiments of the disclosure. Graph 300 includes signal bandgap voltage 310 that is illustrated as having a ΔV (change in voltage) over temperature. For example, the signal bandgap voltage 310 increases over a ΔT (change in temperature) period 312 and decreases over a ΔT (change in temperature) period 314.

Unified PWL correction voltage 320 is similar to the (unified) curve 240 discussed above. The unified PWL correction voltage is arranged, for example, with each segment being approximately one-third of the length of time being defined by periods 312 and 314. For example, period 322 (which encompasses the negative-going segment of the PWL correction voltage 320), period 324 (which encompasses the substantially flat segment of the PWL correction voltage 320), and period 326 (which encompasses the negative-going segment of the PWL correction voltage 320) are substantially the same length.

In various example embodiments, other arrangements of the lengths of periods 322, 324, and 326 are possible. For example, the length of period 324 can be shorter, with the lengths of periods 322 and 326 made longer (although the tolerances of VBG_HI and VBG_LO with respect to the maximum value of the bandgap voltage are lessened).

Waveform 330 illustrates a compensated bandgap voltage that has been compensated using the unified PWL correction voltage 230 signal. Waveform 330 includes a segment 332 that decreases in amplitude in response to (for example) the negative-going PWL correction voltage, a segment 344 that increases in response to (for example) increasing temperature, a segment 346 that decreases in response to (for example) increasing temperature, and a segment 338 that increases in amplitude in response to (for example) the positive-going PWL correction voltage. In various embodiments, complementary signals and circuitry can be used, such that the illustrated signals are inverted.

The example compensated ΔV (change in voltage) over temperature for waveform 330 (as discussed below with reference to FIG. 7, for example) is around four times less than the uncompensated bandgap voltage ΔV over temperature, thus indicating an improvement in temperature stability over the uncompensated bandgap voltage.

Figure 4:
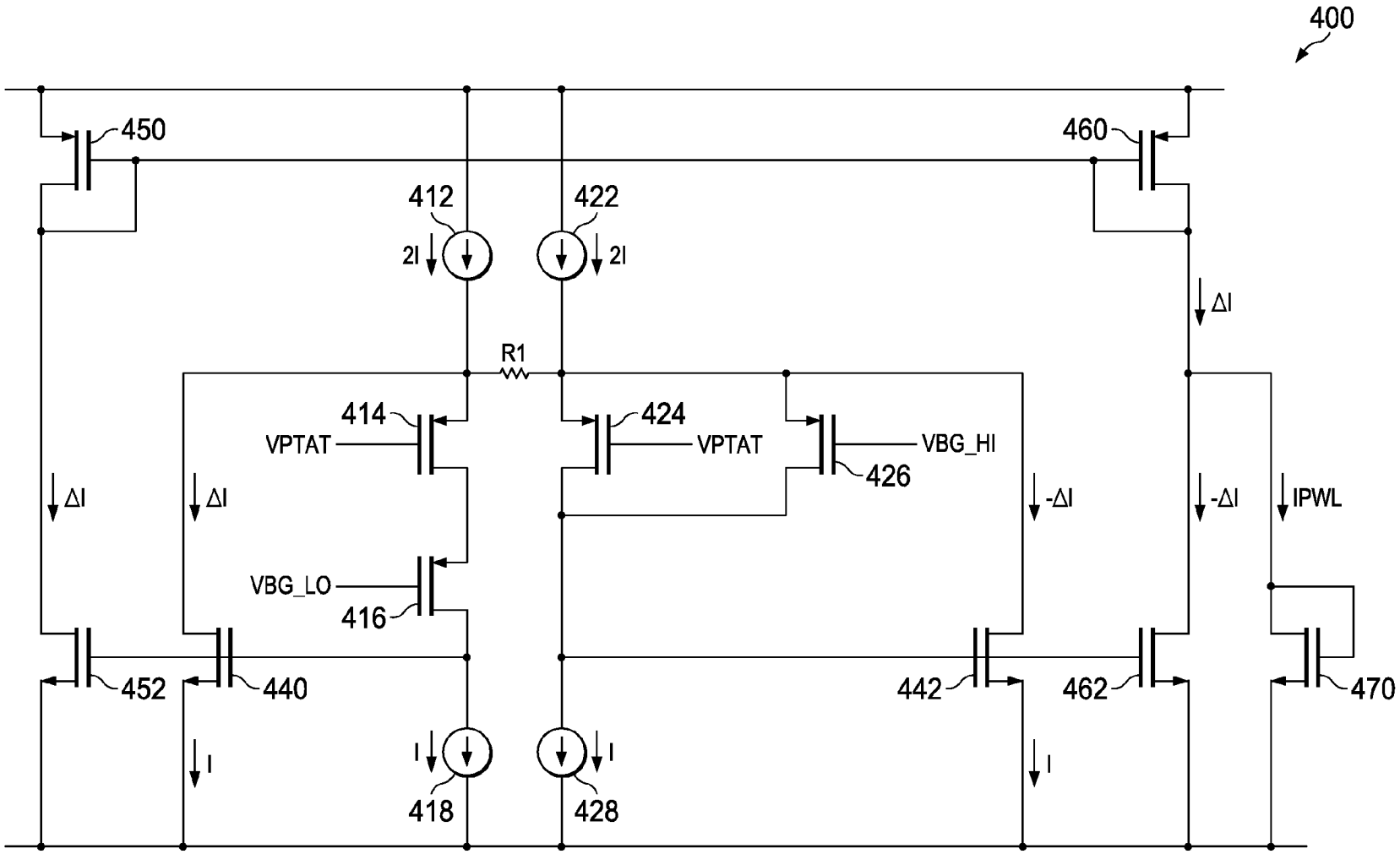
FIG. 4 is a schematic diagram illustrating a unified PWL bandgap voltage waveform compensation amplifier in accordance with example embodiments of the disclosure.

FIG. 4 is a schematic diagram illustrating a unified PWL bandgap voltage waveform compensation amplifier in accordance with example embodiments of the disclosure. Unified PWL bandgap voltage waveform compensation amplifier 400 includes a first and a second amplifier that are electrically coupled together via coupler R1. Coupler R1 is, for example, a resistor that is arranged to permit current flow from one amplifier to the other amplifier and to linearize the compensated output of the unified PWL bandgap voltage waveform compensation amplifier 400. Further, the sharing of the coupler R1 between the amplifiers, for example, eliminates resistive mismatch that would otherwise occur using separate resistors in separate amplifiers (and would also decrease overall bandgap voltage accuracy).

PMOS (positive-type metal oxide semiconductor) input transistors 414 and 416 are used by the first amplifier to control a current in response to the signals VPTAT and VBG_LO, respectively. The ("head") current (which is supplied by current source 412 having a nominal value of "2I") is coupled such that half of the supplied current (having a nominal value of "I") flows through transistors 414 and 416 (via current source 418) and the other half of the supplied current (also having a nominal value of "I") flows through the NMOS (negative-type metal oxide semiconductor) load transistor 440. Transistor 440 is biased by the voltage at the input of the current source 418, thus providing a feedback loop (discussed below) and causing transistor 440 to mirror the current of the current source 418. (The term current "source" also includes the meaning of current "sink" as, for example, determined by placement within a schematic and the direction of flow of current.)

PMOS (positive-type metal oxide semiconductor) input transistors 424 and 426 are used by the first amplifier to control a current in response to the signals VPTAT and VBG_HI, respectively. The ("head") current (which is supplied by current source 422 having a nominal value of "2I") is coupled such that around half of the supplied current (having a nominal value of "I") flows through transistors 424 and 426 (via current source 428) and the other half of the supplied current (also having a nominal value of "I") flows through the NMOS (negative-type metal oxide semiconductor) load transistor 442. Transistor 442 is biased by the voltage at the input of the current source 428, thus causing transistor 440 to mirror the current of the current source 428.

Input transistors 414 and 416 of the first amplifier are coupled in series (e.g., a transistor "stack") between current sources 412 and 418, whereas input transistors 424 and 426 of the second amplifier are coupled in parallel between current sources 412 and 418. Accordingly, input transistors 414 and 416 each have a size ratio of twice the size of each of input transistors 424 and 426.

In operation, the signal VPTAT provides a voltage that varies with temperature. As described above with reference to FIG. 3, the signal bandgap voltage 310 increases with temperature over period 312 and then decreases with temperature over period 314. Accordingly, the current "ΔI" through load transistor 440 is a temperature dependent current. For example, ΔI is equal to twice the value of ΔV divided by the value in Ohms of the coupler R1 (when the transconductance times the value of the coupler R1 is much greater than one). The drain of transistor 416 is modulated by load transistor 440, which provides a feedback mechanism (from the drain of transistor 416 to the source of transistor 414). The feedback mechanism substantially prevents the transconductance of the transistors 414 and 416 from changing, which maintains linearity over a larger input range of VPTAT voltages.

Likewise, the current "−ΔI" through load transistor 442 is a temperature dependent current. The drain of transistor 424 is modulated by load transistor 444, which provides a feedback mechanism (from the drain to the source of transistor 424). The feedback mechanism substantially maintains the transconductance of the transistors 424 and 426 to help preserve linearity over temperature.

As illustrated, output signal IPWL is generated in response to current mirroring of current "ΔI" through transistor 440. For example, NMOS transistor 452 is biased similarly to transistor 440 so that current ΔI also flows through transistor 452. PMOS transistors 450 and 460 have sources tied to the high side power rail and are arranged as a current mirror such that current ΔI (which flows through transistors 450 and 452) also flows through transistor 460. However, NMOS transistor 462 is biased similarly to transistor 442 so that current −ΔI also flows through transistor 462. Signal IPWL is difference of current ΔI and current −ΔI and is carried through self-biased (e.g., where the source is coupled to the gate) NMOS transistor 470.

When VPTAT is less than VBG_LO, the ΔI varies in accordance with a positive temperature coefficient, and signal IPWL has a negative-going slope as illustrated by segment 242 (illustrated in FIG. 2). When VPTAT is greater than VBG_LO and less than VBG_HI, the ΔI varies in accordance with a negative temperature coefficient, and signal IPWL has a horizontal (e.g., zero) slope as illustrated by segment 244. When VPTAT is greater than VBG_HI, the ΔI varies in accordance with a positive temperature coefficient, and signal IPWL has a positive-going slope as illustrated by segment 246.

Figure 5:
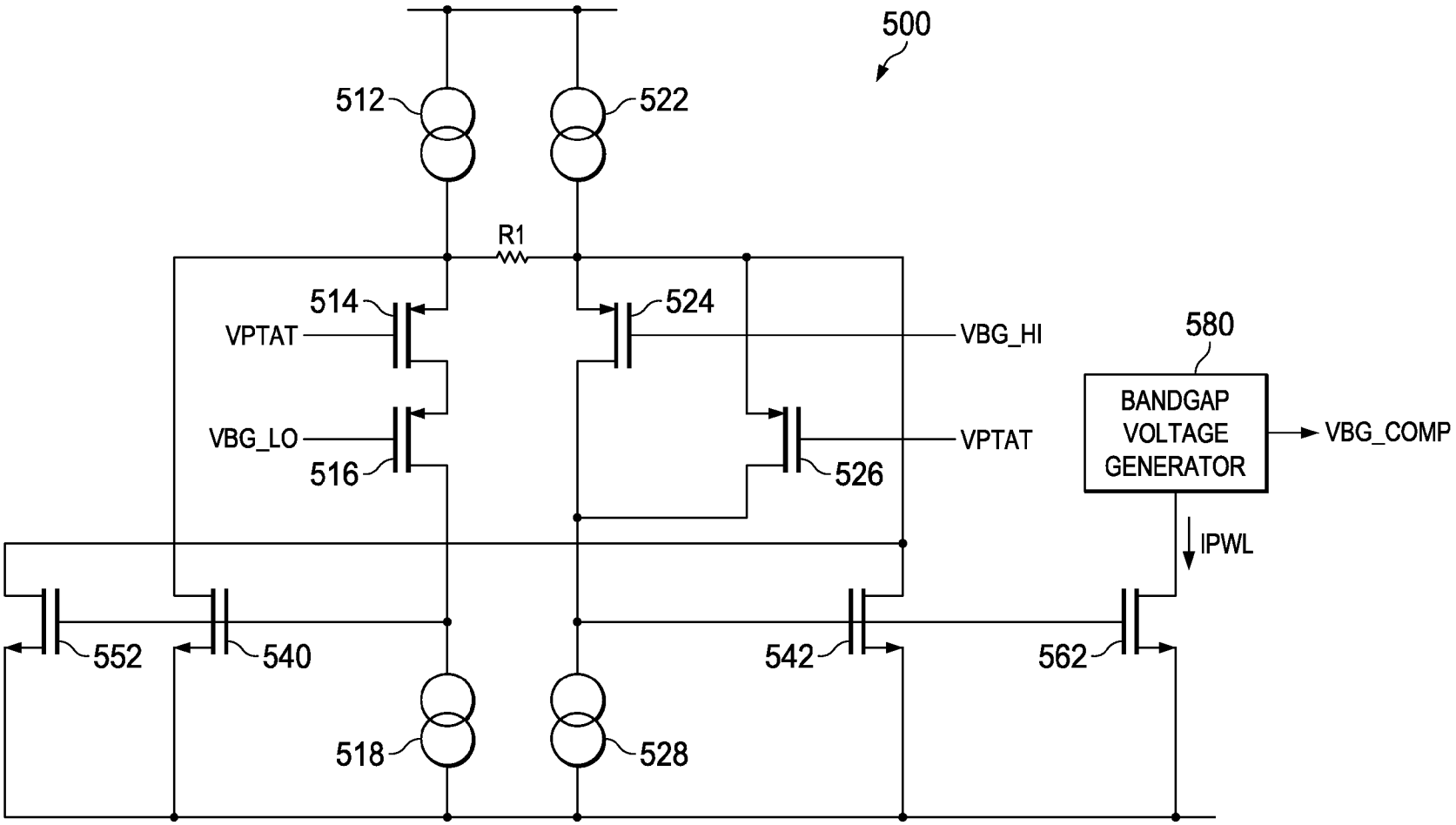
FIG. 5 is a schematic diagram illustrating a reduced-size unified PWL bandgap voltage waveform compensation amplifier in accordance with example embodiments of the disclosure.

FIG. 5 is a schematic diagram illustrating a reduced-size unified PWL bandgap voltage waveform compensation amplifier in accordance with example embodiments of the disclosure. The unified PWL bandgap voltage waveform compensation amplifier 500 does not include a current mirror (e.g., provided by the PMOS mirror transistors 450 and 460), which consumes less power and requires less layout area.

Unified PWL bandgap voltage waveform compensation amplifier 500 includes a first and a second amplifier that are electrically coupled together via coupler R1. Coupler R1 is, for example, a resistor that is arranged to permit current flow from one amplifier to the other amplifier and to linearize the compensated output of the unified PWL bandgap voltage waveform compensation amplifier 500.

PMOS (positive-type metal oxide semiconductor) input transistors 514 and 516 are used by the first amplifier to control a current in response to the signals VPTAT and VBG_LO, respectively. The ("head") current (which is supplied by current source 512 having a nominal value of "2I") is coupled such that half of the supplied current (having a nominal value of "I") flows through transistors 514 and 516 (as controlled by current source 518) and the other half of the supplied current (also having a nominal value of "I") flows through the NMOS (negative-type metal oxide semiconductor) load transistor 540. Transistor 540 is biased by the voltage at the input of the current source 518, thus providing a feedback loop and causing transistor 540 to mirror the current of the current source 518.

PMOS (positive-type metal oxide semiconductor) input transistors 524 and 526 are used by the first amplifier to control a current in response to the signals VPTAT and VBG_HI, respectively. The ("head") current (which is supplied by current source 522 having a nominal value of "2I") is coupled such that around half of the supplied current (having a nominal value of "I") flows through transistors 524 and 526 (via current source 528) and the other half of the supplied current (also having a nominal value of "I") flows through the NMOS (negative-type metal oxide semiconductor) load transistor 542.

The drain of transistor 516 is modulated by load transistor 540, which provides a feedback mechanism (from the drain of transistor 516 to the source of transistor 514). The feedback mechanism substantially prevents the transconductance of the transistors 514 and 516 from changing, which maintains linearity over a larger input range of VPTAT voltages. Likewise, the drains of transistor 524 and 526 are modulated by load transistor 544, which provides a feedback mechanism (e.g., from the drain to the source of transistor 524).

Input transistors 514 and 516 of the first amplifier are coupled in series (e.g., a transistor "stack") between current sources 512 and 518, whereas input transistors 524 and 526 of the second amplifier are coupled in parallel between current sources 512 and 518. Accordingly, input transistors 514 and 516 each have a size ratio of twice the size of each (e.g., active area) of input transistors 524 and 526.

In operation, the signal VPTAT provides a voltage that varies with temperature. As described above with reference to FIG. 3, the signal bandgap voltage 310 increases with temperature over period 312 and then decreases with temperature over period 314. Accordingly, the current ΔI through load transistor 540 is a temperature dependent current. The drain of transistor 516 is modulated by load transistor 540, which provides a feedback mechanism (from the drain of transistor 516 to the source of transistor 514). The feedback mechanism substantially prevents the transconductance of the transistors 514 and 516 from changing, which maintains linearity over a larger input range of VPTAT voltages.

Likewise, the current −ΔI through load transistor 542 is a temperature dependent current. The drain of transistor 524 is modulated by load transistor 544, which provides a feedback mechanism (from the drain to the source of transistor 524). The drain of transistor 524 is further coupled to the source of NMOS transistor 552. Transistor 552 is biased by the voltage at the gate of transistor 540, thus causing transistor 552 to (in proportion to the bias voltage of gate 552) subtract current (e.g., supplied from current source 522 and coupler R1) that would otherwise flow through transistor 542. Because the subtraction of currents from the source of transistor 542 is fed-back to the source of transistor 524, the bias voltage applied to the gate of 542 reflects any ΔI of transistor 540. The bias voltage applied to the gate of 542 is also applied to transistor 562, such that transistor 562 is arranged to sink a current in response to the subtraction of currents.

The output NMOS transistor 562 is the current signal IPWL. The IPWL is coupled to the bandgap voltage generator 580 and is arranged to compensate the output voltage or the bandgap voltage generator 580 to produce the voltage bandgap compensated (VBG_COMP). For example the IPWL can be injected into a bandgap generator output resistive ladder to compensate for temperature-dependent curvature of the output voltage. The curvature of the output voltage can be adjusted (e.g., in a post-fabrication environment) using laser trimming (e.g., at little or no additional cost). The unified PWL bandgap voltage waveform compensation amplifier 500 can be used as a stable voltage reference as a low-cost on-chip resource for analog-to-digital converters.

Figure 6:
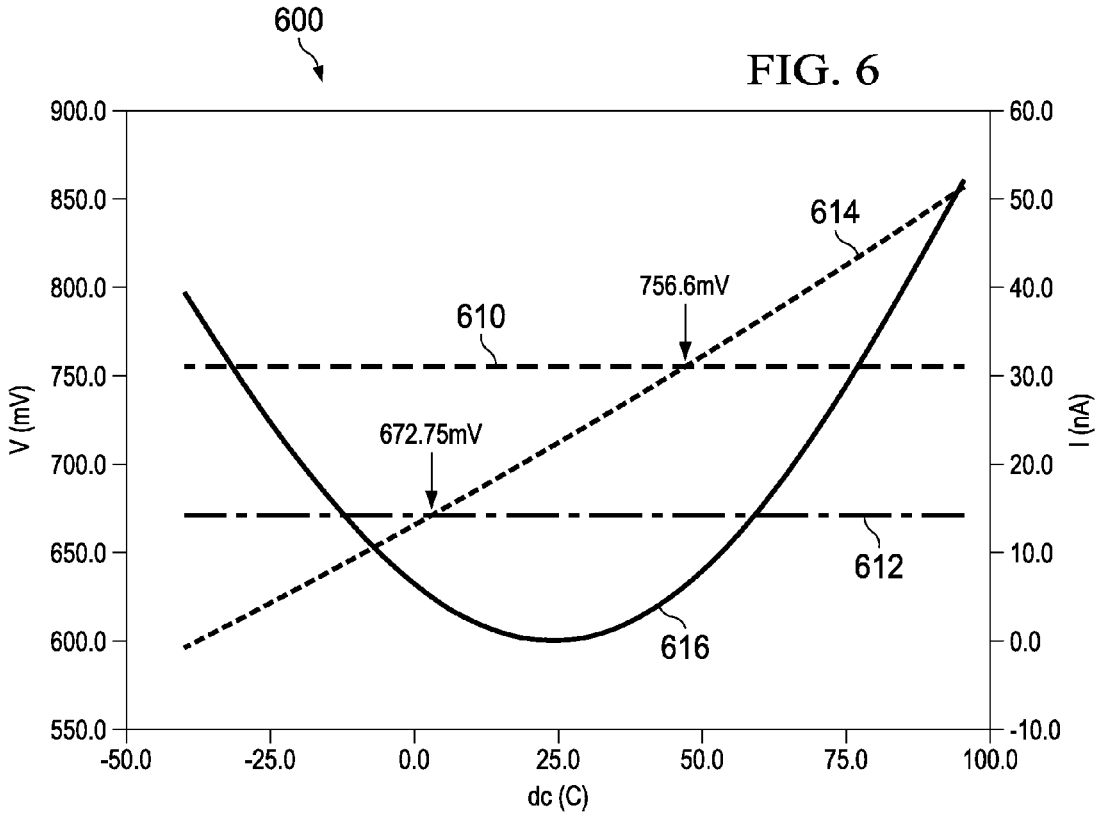
FIG. 6 is a waveform diagram illustrating unified PWL bandgap voltage compensation control parameters over temperature in accordance with example embodiments of the disclosure.

FIG. 6 is a waveform diagram illustrating unified PWL bandgap voltage compensation control parameters over temperature in accordance with example embodiments of the disclosure. Graph 600 includes signal VBG_HI (voltage bandgap high) 610 and signal VBG_LO (voltage bandgap low) 212 that are illustrated as remaining substantially constant. Signal VPTAT (voltage proportional to absolute temperature) 614 is illustrated in graph 600 as increasing as a function of temperature (e.g., where temperature increases from left to right).

Signal 616 illustrates a current ΔI, such as the current carried through load transistor 540. Signal 616 is quantized in units of nano-Amperes (nA), as graphed using the right-hand vertical scale. Signal 616 is symmetrical with respect to a middle (e.g., minimum) point that occurs at a temperature of around 25 degrees Celsius. At this point, the current ΔI is zero nA, and the current ΔI increases parabolically with either increasing or decreasing temperature.

The intersection of signal VPTAT 614 with VBG_HI 610 represents first point that occurs at a temperature of around 5 degrees Celsius, where the VPTAT signal 614 has a voltage of around 672.75 mV. The intersection of signal VPTAT 614 with VBG_HI 610 can be a second point that occurs at a temperature of around 45 degrees Celsius, where the VPTAT signal 614 has a voltage of around 756.6 mV. (Actual values can vary in accordance with process parameters and design rules used to implement the unified PWL bandgap voltage waveform compensation amplifier 500, for example.) Thus, the first and second points are centered about the middle point of signal 616, which represents the inflection point of the bandgap voltage curve 712 discussed below with respect to FIG. 7.

Figure 7:
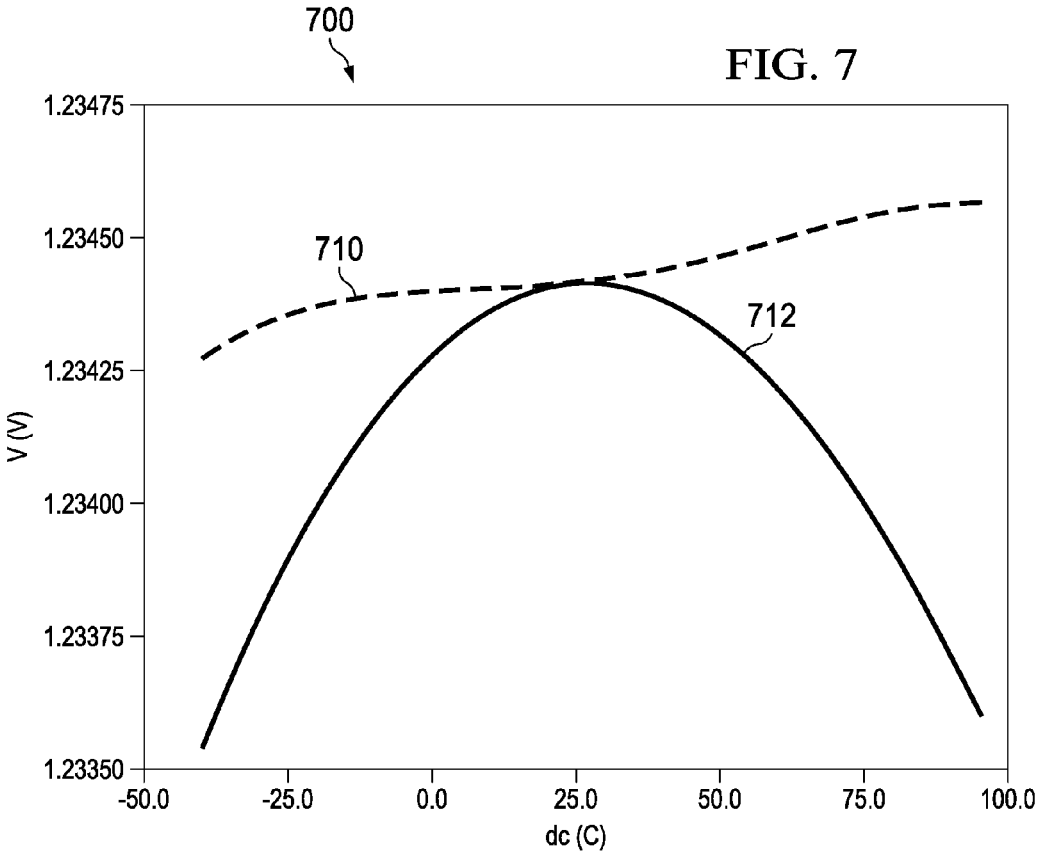
FIG. 7 is a waveform diagram illustrating unified PWL bandgap voltage compensation over temperature in accordance with example embodiments of the disclosure

FIG. 7 is a waveform diagram illustrating unified PWL bandgap voltage compensation over temperature in accordance with example embodiments of the disclosure. Graph 700 includes a compensated bandgap voltage signal 710 and that is illustrated in graph 700 as increasing as a function of temperature (e.g., where temperature increases from left to right) over a horizontal axis that represents increasing temperatures and a vertical axis that represents a value measured in Volts.

Graph 700 also includes an uncompensated bandgap voltage signal 720 and that is illustrated in graph 700 as having a point of inflection (e.g., maximum voltage) at a point that occurs at a temperature of around 25 degrees Celsius and a voltage around 1.23457 Volts. The uncompensated bandgap voltage signal 720 parabolically increases as temperature increases or decreases. The compensated bandgap voltage signal 710 curve and the uncompensated bandgap voltage signal 720 curve intersect at the point of inflection (e.g., where the current ΔI has a value of zero nA).

The compensated bandgap voltage signal 710 has a curvature of around 0.58 parts-per-million (PPM) per degree Celsius and a non-linear error of 1.3 ppm/C that is introduced by the curvature compensation. In contrast, the uncompensated bandgap voltage signal 720 has a raw (e.g., uncompensated) bandgap curvature of 6 ppm/C.

The various embodiments described above are provided by way of illustration only and should not be construed to limit the claims attached hereto. Those skilled in the art will readily recognize various modifications and changes that could be made without following the example embodiments and applications illustrated and described herein, and without departing from the true spirit and scope of the following claims.

What is claimed is:

1. A unified temperature correction generator circuit, comprising:

a first amplifier that is arranged to receive a first current signal and to generate a first correction signal in accordance with a PTAT signal and a first reference voltage;

a second amplifier that is arranged to receive a first current signal and to generate a second correction signal in accordance with the PTAT signal and a second reference voltage;

a coupler that is coupled between the first and second amplifier and is arranged to limit current flow between the first and the second current signal; and an output amplifier that is arranged to generate a combined correction signal in response to the first and second correction signals.

2. The circuit of claim 1, wherein the first and second current signals are generated by a first and second current source.

3. The circuit of claim 2, wherein the first amplifier includes a first transistor having a gate that is coupled to the PTAT signal and a source that is coupled to the first current source and to a first terminal of the coupler, and wherein the second amplifier includes a first transistor having a gate that is coupled to the PTAT signal and a source that is coupled to the second current source and to a second terminal of the coupler.

4. The circuit of claim 3, wherein the first amplifier includes a second transistor that is coupled in series with the first transistor of the first amplifier, and wherein the second amplifier includes a second transistor that is coupled in parallel with the first transistor of the second amplifier.

5. The circuit of claim 4, wherein the first and second transistors of the first amplifier each have a size ratio of around two with respect to the first and second transistors, respectively, of the second amplifier, and wherein the first current signal has a value that is around the value of the second current signal.

6. The circuit of claim 5, wherein the second transistor of the first amplifier includes a gate that is coupled to the first voltage threshold, and wherein the second transistor of the first amplifier includes a gate that is coupled to the second voltage threshold.

7. The circuit of claim 6, wherein the first amplifier is arranged to generate the first correction signal in response to the PTAT signal when the PTAT signal is less than the first voltage threshold, and wherein the second amplifier is arranged to generate the second correction signal in response to the PTAT signal when the PTAT signal is greater than the second voltage threshold.

8. The circuit of claim 7, wherein first correction signal is associated with a positive temperature coefficient when the PTAT signal is less than the first voltage threshold, and wherein the second correction signal is associated with a negative temperature coefficient when the PTAT signal is greater than the second voltage threshold.

9. The circuit of claim 6, further comprising a third current source having an input that is arranged to receive a first amplifier current from the first amplifier wherein the first amplifier current has a value that is around half of the value of the first current signal, and comprising a fourth current source having an input that is arranged to receive a second amplifier current from the second amplifier, wherein the second amplifier current has a value that is around half of the value of the first current signal.

10. The circuit of claim 9, further comprising a first load transistor that is coupled in parallel with the first amplifier and that is arranged to receive a first feedback current that has a value that is around half of the value of the first current signal, and comprising a second load transistor that is coupled in parallel with the second amplifier and that is arranged to receive a second feedback current that has a value that is around half of the value of the second current signal.

11. The circuit of claim 10, wherein the gate of the first load transistor is coupled to the input of the third current source, and wherein the gate of the second load transistor is coupled to the input of the fourth current source.

12. The circuit of claim 11, wherein the output amplifier that is arranged to generate the combined correction signal by mirroring the first feedback current to produce a first mirrored current, by mirroring the second feedback current to produce a second mirrored current, and by subtracting the second mirrored current from the first mirrored current.

13. The circuit of claim 11, wherein the output amplifier includes a first output transistor having a gate that is coupled to the input of the third current source and having a source that is coupled to the source of the second load transistor, wherein the output amplifier further includes a second output transistor having a gate that is coupled to the input of the fourth current source and having a source that is coupled to a bandgap voltage generator.

14. A temperature-compensated bandgap voltage generator, comprising:

a first amplifier that is arranged to receive a first current signal and to generate a first correction signal in accordance with a PTAT signal and a first reference voltage;

a second amplifier that is arranged to receive a first current signal and to generate a second correction signal in accordance with the PTAT signal and a second reference voltage;

a coupler that is coupled between the first and second amplifier and is arranged to limit current flow between the first and the second current signal;

an output amplifier that is arranged to generate a combined correction signal in response to the first and second correction signals; and a temperature-compensated bandgap voltage generator that is arranged to generate a temperature-compensated output voltage in response to the combined correction signal.

15. The generator of claim 14, wherein the first amplifier includes a first transistor having a gate that is coupled to the PTAT signal and a source that is coupled to the first current source and to a first terminal of the coupler, wherein the first amplifier includes a second transistor responsive to a first voltage threshold and that is coupled in series with the first transistor of the first amplifier, wherein the second amplifier includes a first transistor having a gate that is coupled to the PTAT signal and a source that is coupled to the second current source and to a second terminal of the coupler, and wherein the second amplifier includes a second transistor responsive to a second voltage threshold and that is coupled in parallel with the first transistor of the second amplifier.

16. The generator of claim 15, wherein the first amplifier is arranged to generate the first correction signal in response to the PTAT signal when the PTAT signal is less than the first voltage threshold, and wherein the second amplifier is arranged to generate the second correction signal in response to the PTAT signal when the PTAT signal is greater than the second voltage threshold.

17. The generator of claim 16, wherein the combined correction signal is generated in response to subtracting the first correction signal from the second correction signal.

18. A method, comprising:

generating a first correction signal in a first amplifier in accordance with a PTAT signal and a first reference voltage;

generating a second correction signal in a second amplifier in accordance with the PTAT signal and a second reference voltage;

coupling a resistor between the first and second amplifier, wherein the resistor is arranged to limit current flow between the first and the second amplifier;

generating a combined correction signal in an output amplifier in response to the first and second correction signals.

19. The method of claim 18, wherein the combined correction signal is generated in response to subtracting the first correction signal from the second correction signal.

20. The method of claim 19, further comprising generating a temperature-compensated voltage output in response to the combined correction signal.

* * * * *